US009610770B2

(12) United States Patent
Naganuma et al.

(10) Patent No.: US 9,610,770 B2
(45) Date of Patent: Apr. 4, 2017

(54) LIQUID EJECTING HEAD AND LIQUID EJECTING APPARATUS

(71) Applicant: SEIKO EPSON CORPORATION, Tokyo (JP)

(72) Inventors: Yoichi Naganuma, Matsumoto (JP); Yoshinao Miyata, Matsukawa-mura (JP); Eiju Hirai, Minowa-machi (JP); Motoki Takabe, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/594,557

(22) Filed: Jan. 12, 2015

(65) Prior Publication Data

US 2015/0202870 A1 Jul. 23, 2015

(30) Foreign Application Priority Data

Jan. 17, 2014 (JP) ..... 2014-006678

(51) Int. Cl.
*B41J 2/04* (2006.01)
*B41J 2/14* (2006.01)

(52) U.S. Cl.
CPC .. *B41J 2/14233* (2013.01); *B41J 2002/14491* (2013.01); *B41J 2202/11* (2013.01)

(58) Field of Classification Search
None
See application file for complete search history.

(56) References Cited

U.S. PATENT DOCUMENTS 5,828,390 A * 10/1998 Thiel ..... B41J 2/161 347/40
5,850,240 A * 12/1998 Kubatzki et al. ..... 347/49
2004/0004649 A1* 1/2004 Bibl ..... B41J 2/14233 347/68
2007/0064062 A1* 3/2007 Sugimoto ..... B41J 2/1606 347/68
2010/0053252 A1* 3/2010 Matsushita ..... B41J 2/04525 347/17
2012/0069093 A1* 3/2012 Kuwata ..... B41J 2/055 347/47
2013/0194352 A1 8/2013 Watanabe et al.

FOREIGN PATENT DOCUMENTS

JP 2013-154485 8/2013

* cited by examiner

*Primary Examiner* — Erica Lin
(74) *Attorney, Agent, or Firm* — Workman Nydegger

(57) ABSTRACT

Provided is a liquid ejecting head including a pressure chamber forming substrate for forming a pressure chamber which is filled with liquid, a nozzle through which the ink is ejected in a direction along the pressure chamber forming substrate, and a communication flow path which allows the pressure chamber to communicate with the nozzle. The nozzle and the communication flow path are formed in the pressure chamber forming substrate.

4 Claims, 7 Drawing Sheets

LIQUID EJECTING HEAD AND LIQUID EJECTING APPARATUS

CROSS-REFERENCE TO RELATED APPLICATIONS

The present application claims priority to Japanese Patent Application No. 2014-006678 filed on Jan. 17, 2014, which is hereby incorporated by reference in its entirety.

BACKGROUND

1. Technical Field

The present invention relates to technology relating to ejection of liquid, such as ink.

2. Related Art

There are various types of technology relating to ejection of liquid, such as ink, onto a printing medium, such as a paper sheet for printing. A liquid ejecting head in which a pressure chamber forming substrate for forming a pressure chamber, a nozzle plate for forming a nozzle, and a communication substrate for forming a nozzle communication path through which the pressure chamber communicates with the nozzle are stacked on each other has been disclosed in, for example, JP-A-2013-154485.

In the configuration disclosed in JP-A-2013-154485, the pressure chamber forming substrate, the communication substrate, and the nozzle plate, all of which have a plate shape, are disposed in a state where the posture thereof is perpendicular to an ink ejection direction. Accordingly, when viewed from a printing medium side, the area (which is the area of a liquid ejection surface of the liquid ejecting head) of the head is great. Thus, it is difficult to arrange a plurality of nozzles with high density. Furthermore, in the case of a configuration in which a plurality of liquid ejecting heads are arranged, a plurality of nozzles are distributed over a wide range. Accordingly, it is difficult to maintain a uniform gap between the liquid ejection surface and a printing medium, over a plurality of heads.

In the configuration disclosed in JP-A-2013-154485, the pressure chamber, the nozzle communication path, and the nozzle are formed in separate substrates. Accordingly, when the liquid ejecting head is manufactured, it is difficult to form, with high accuracy, a flow path from the pressure chamber to the nozzle. Particularly, an error is likely to occur in the flow path, at a bonded portion between the substrates. As a result, ejection properties (such as an ejection amount, an ejecting direction, and the like) of liquid ejected from the nozzles are likely to deviate from designed values, and thus a variation in the ejection properties occurs. Furthermore, a configuration in which the pressure chamber forming substrate, the communication substrate, and the nozzle plate are constituted of silicon single crystal substrates is disclosed in JP-A-2013-154485. However, when materials of the three substrates differ from each other, the degree of thermal expansion is different for each substrate. Accordingly, the error in the flow path, which occurs at the bonded portion between the substrates, varies due to a temperature (heat). As a result, the variation in ejection properties becomes more significant.

SUMMARY

An advantage of some aspects of the invention is to reduce the area of a liquid ejecting head, viewed from a liquid ejecting direction, and suppress the variation in ejection properties with a simple configuration.

According to an aspect of the invention, there is provided a liquid ejecting head including a pressure chamber forming substrate for forming a pressure chamber which is filled with liquid, a nozzle through which the liquid is ejected in a direction along the pressure chamber forming substrate, and a communication flow path which allows the pressure chamber to communicate with the nozzle, in which the nozzle and the communication flow path are formed in the pressure chamber forming substrate.

In this case, liquid is ejected in the direction along the pressure chamber forming substrate. Thus, the area of the liquid ejecting head, viewed from the ink ejection direction, can be reduced, compared to the configuration disclosed in JP-A-2013-154485, in which a pressure chamber forming substrate, a communication substrate, and a nozzle plate are disposed in a state where the posture thereof is perpendicular to the ink ejection direction. As a result, a plurality of nozzles can be provided with high density and, further, it is easy to maintain a uniform gap between a liquid ejection surface and a printing medium. Furthermore, since the pressure chamber, the communication flow path, and the nozzle are formed in the same substrate (which is the pressure chamber forming substrate), the flow paths from the pressure chambers to the nozzles can be formed with high accuracy. Accordingly, it is possible to eliminate the possibility that an error may occur, in a flow path, at a bonded portion between the substrates and the extent of the error may vary due to temperature. As a result, it is possible to suppress the variation in ejection properties of liquid ejected from the nozzles. Furthermore, the pressure chamber, the communication flow path, and the nozzle can be formed by a common process (for example, etching of a plate material). As a result, it is possible to simplify the manufacturing process of the liquid ejecting head. In addition, since it is not necessary to provide a nozzle plate, the number of parts is reduced. Thus, the configuration of the liquid ejecting head can be simplified. Furthermore, it is not necessary to flatten the surfaces to which a nozzle plate is bonded. As a result, it is possible to reduce the accuracy necessary for manufacturing or assembling of the liquid ejecting head. Therefore, according to the invention, the area of the liquid ejecting head, viewed from the liquid ejection direction, can be reduced and the variation in ejection properties can be suppressed with a simple configuration.

In the liquid ejecting head, it is preferable that the liquid ejecting head further include a liquid storage chamber which is formed in the pressure chamber forming substrate and in which liquid to be supplied to the pressure chamber is stored.

In this case, the liquid storage chamber, in addition to the pressure chamber, the communication flow path, and the nozzle, is formed in the pressure chamber forming substrate. As a result, the configuration of the liquid ejecting head can be simplified, compared to the configuration in which the liquid storage chamber is formed in a substrate separate from the pressure chamber forming substrate.

In the liquid ejecting head, it is preferable that the liquid ejecting head further include a compliance sheet having flexibility which is disposed on one surface of the pressure chamber forming substrate and constitutes a wall surface of the liquid storage chamber.

In this case, the wall surface of the liquid storage chamber is constituted by the compliance sheet which has flexibility and is disposed on one surface of the pressure chamber forming substrate. Accordingly, pressure change in the liquid storage chamber can be suppressed (absorbed) by the compliance sheet. Furthermore, it is possible to more stably supply, to the pressure chamber, the liquid stored in the liquid storage chamber, compared to the configuration in which the compliance sheet is not provided. As a result, it is possible to further suppress the variation in ejection properties.

In the liquid ejecting head, it is preferable that the liquid ejecting head further include a communication plate which is disposed on one surface of the pressure chamber forming substrate and forms a liquid storage chamber in which liquid to be supplied to the pressure chamber is stored.

In this case, the liquid storage chamber is formed in a substrate (which is the communication plate) separate from the pressure chamber forming substrate. As a result, the liquid storage chamber having adequate capacity can be obtained regardless of the thickness of the pressure chamber forming substrate (for example, even when the thickness of the pressure chamber forming substrate is thin).

In the liquid ejecting head, it is preferable that the liquid ejecting head further include a compliance sheet having flexibility which is disposed on a surface of the communication plate, which is the surface opposite to a surface facing the pressure chamber forming substrate, and constitutes a wall surface of the liquid storage chamber.

In this case, the wall surface of the liquid storage chamber is constituted by the compliance sheet which has flexibility and is disposed on one surface of the communication plate. Accordingly, pressure change in the liquid storage chamber can be absorbed by the compliance sheet. Furthermore, it is possible to more stably supply, to the pressure chamber, the liquid stored in the liquid storage chamber, compared to the configuration in which the compliance sheet is not provided. As a result, it is possible to further suppress the variation in ejection properties.

According to another aspect of the invention, there is provided a liquid ejecting apparatus which includes the liquid ejecting head according to the aspect described above. The liquid ejecting apparatus is, for example, a printer in which ink is ejected onto a printing medium, such as a paper sheet for printing. However, a use of the liquid ejecting apparatus of the invention is not limited to printing.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiment 1

Figure 1:
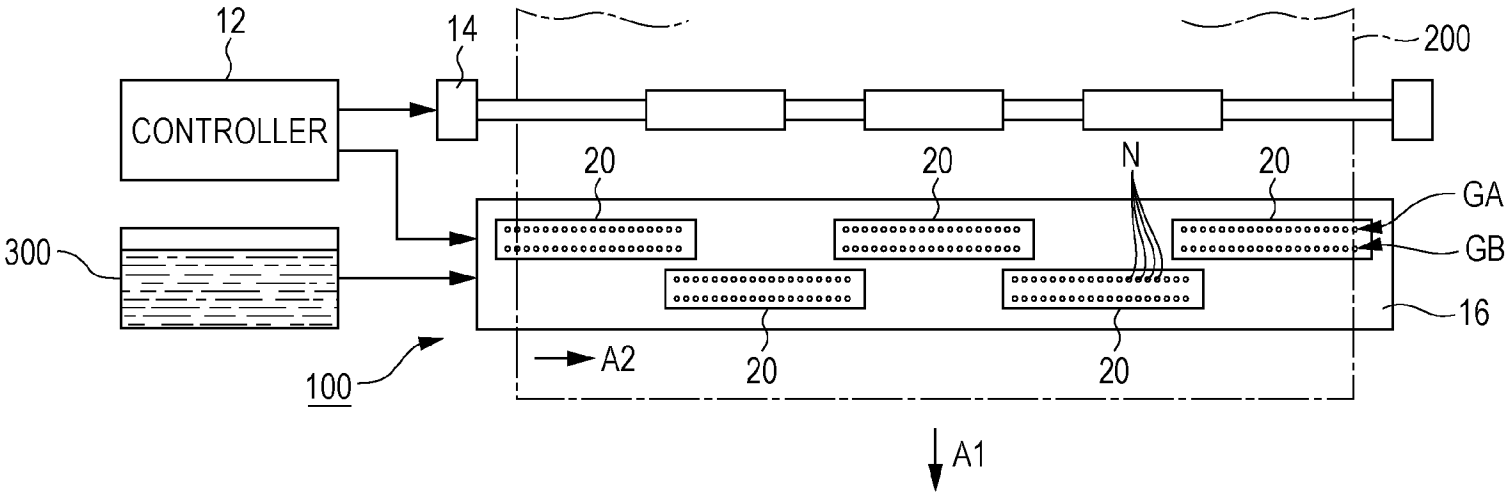
FIG. 1 is a partial configuration view of a printing apparatus according to Embodiment 1.

FIG. 1 is a partial configuration view of a printing apparatus 100 of an ink jet type according to Embodiment 1. The printing apparatus 100 is a liquid ejecting apparatus in which ink as an example of liquid is ejected onto a printing medium 200, such as a paper sheet for printing. The printing apparatus 100 includes a controller 12, a transporting mechanism 14, and a head module 16. The controller 12 collectively controls components of the printing apparatus 100. The transporting mechanism 14 transports the printing medium 200 in a predetermined direction A1, in accordance with the control by the controller 12.

An ink cartridge 300 filled with ink is mounted on the printing apparatus 100. The head module 16 ejects, onto the printing medium 200, ink supplied from the ink cartridge 300, in accordance with the control by the controller 12. The head module 16 is a line head in which a plurality of liquid ejecting heads 20 are arranged to be in two rows, along a direction A2 intersecting (generally, perpendicular to) the transporting direction A1 of the printing medium 200, as illustrated in FIG. 1. The liquid ejecting heads 20 are arranged in a so-called staggered manner. In the illustration of FIG. 1, the positions of respective liquid ejecting heads 20 of both the three liquid ejecting heads 20 constituting the upper-side row in FIG. 1 and the two liquid ejecting heads 20 constituting the lower-side row in FIG. 1 are different in the direction A2. A plurality of head modules 16 can be arranged in parallel, along the transporting direction A1 of the printing medium 200. The head module 16 includes a plurality of liquid ejecting heads 20. The respective liquid ejecting heads 20 have a common configuration.

Figure 2:
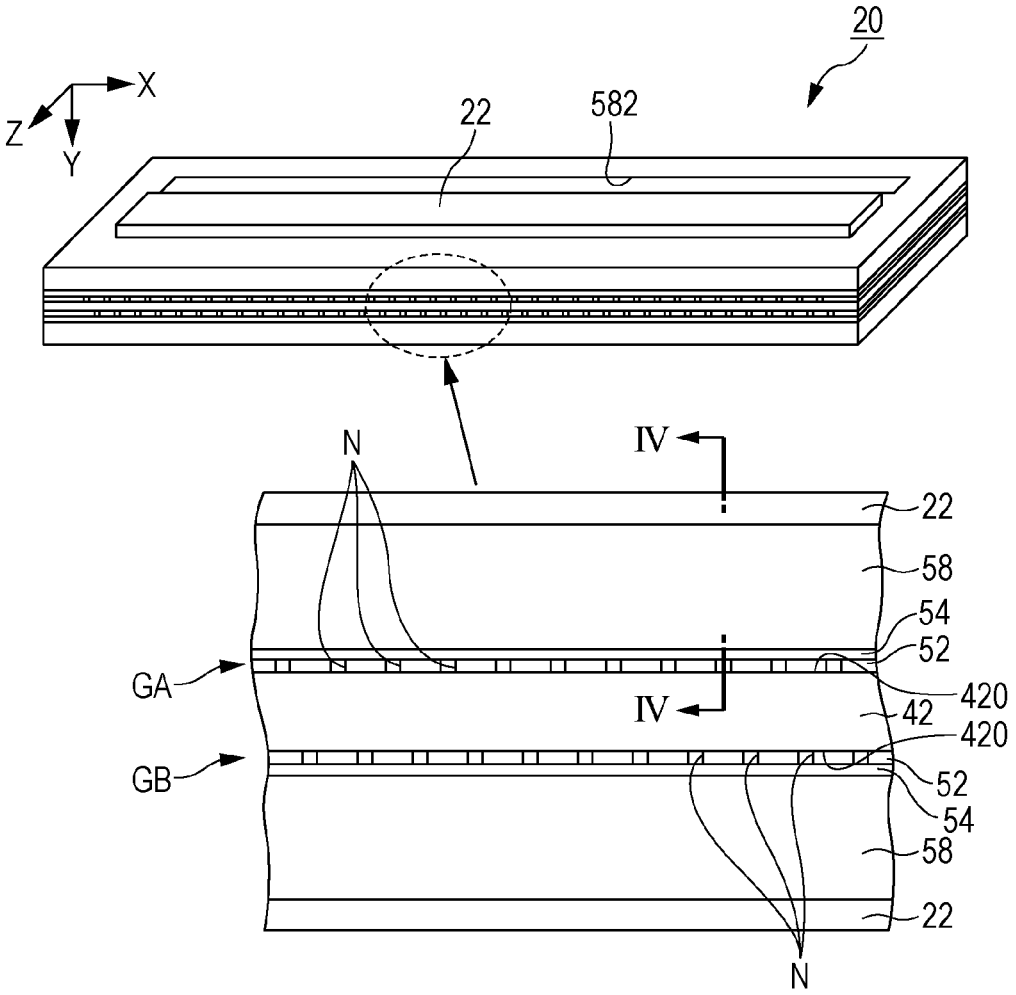
FIG. 2 illustrates a perspective view of a liquid ejecting head and a partially enlarged view thereof.

FIG. 2 illustrates a perspective view of the liquid ejecting head 20 and a partially enlarged view thereof. The liquid ejecting head 20 is a head chip in which ink is ejected onto the printing medium 200 through a plurality of nozzles N arranged to be in two rows (which are a nozzle row GA and a nozzle row GB). An IC chip 22 having a driving circuit embedded therein is mounted on the liquid ejecting head 20. The driving circuit generates driving signals. In the following description, a direction in which ink is ejected from the respective nozzles N of the liquid ejecting head 20 is referred to as a Z direction and a direction (which is the longitudinal direction of the liquid ejecting head 20) in which the nozzle row GA or the nozzle row GB extends is referred to as an X direction. In addition, a direction perpendicular to both the Z direction and the X direction is referred to as a Y direction.

In the printing apparatus 100, each liquid ejecting head 20 is disposed in a state where the Z direction thereof is directed downward (in other words, directed to the printing medium 200 side) in the vertical direction. Accordingly, the XY plane perpendicular to the Z direction is a horizontal plane substantially parallel to the printing medium 200. The nozzles N of the plurality of the liquid ejecting heads 20 are distributed over the range greater than the width (which is the width of the printing medium 200 in the direction A2) of the printing medium 200, as illustrated in FIG. 1. Accordingly, ink is ejected onto the printing medium 200 through the nozzles N of the respective liquid ejecting heads 20 of the head module 16 while the printing medium 200 is transported by the transporting mechanism 14, and in such a manner an image can be printed onto the printing medium 200.

In the liquid ejecting head 20, pressure chamber forming substrates 52, diaphragms 54, and protection plates 58 are stacked on both surfaces (hereinafter, referred to as mounting surfaces) 420 of a base substrate 42 located in the central portion of the liquid ejecting head 20, as illustrated in the enlarged view of FIG. 2. In the protection plate 58, the IC chip 22 is provided on a surface opposite to a surface facing the diaphragm 54. The components on one mounting surface 420 of the base substrate 42 correspond to the nozzle row GA and the components on the other mounting surface 420 thereof correspond to the nozzle row GB. The respective nozzles N constituting the nozzle row GA and the respective nozzles N constituting the nozzle row GB are disposed facing each other, with the base substrate 42 interposed therebetween. In the X direction, the positions of the respective nozzles N of the nozzle row GA are different from the positions of the respective nozzles N of the nozzle row GB, as illustrated in FIG. 2. However, the components on both mounting surfaces 420 of the base substrate 42 are substantially symmetrically arranged with the base substrate 42 interposed therebetween. Furthermore, the specific configurations of the components are the same. Accordingly, in the following description, the focus is placed on the components corresponding to the nozzle row GA and the descriptions of the components corresponding to the nozzle row GB will not be repeated.

Figure 3:
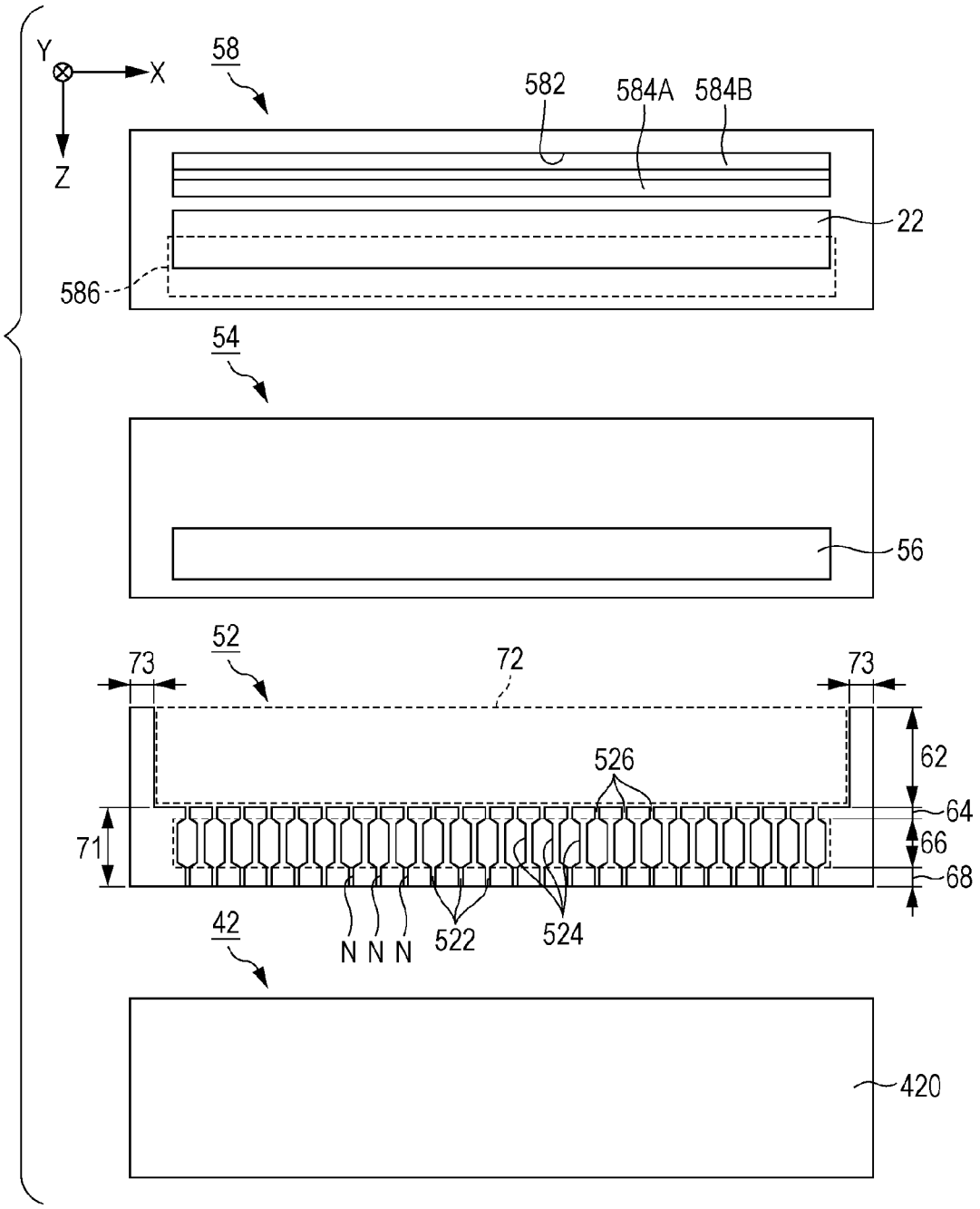
FIG. 3 illustrates plan views of a base substrate, a pressure chamber forming substrate, a diaphragm, and a protection plate.
Figure 4:
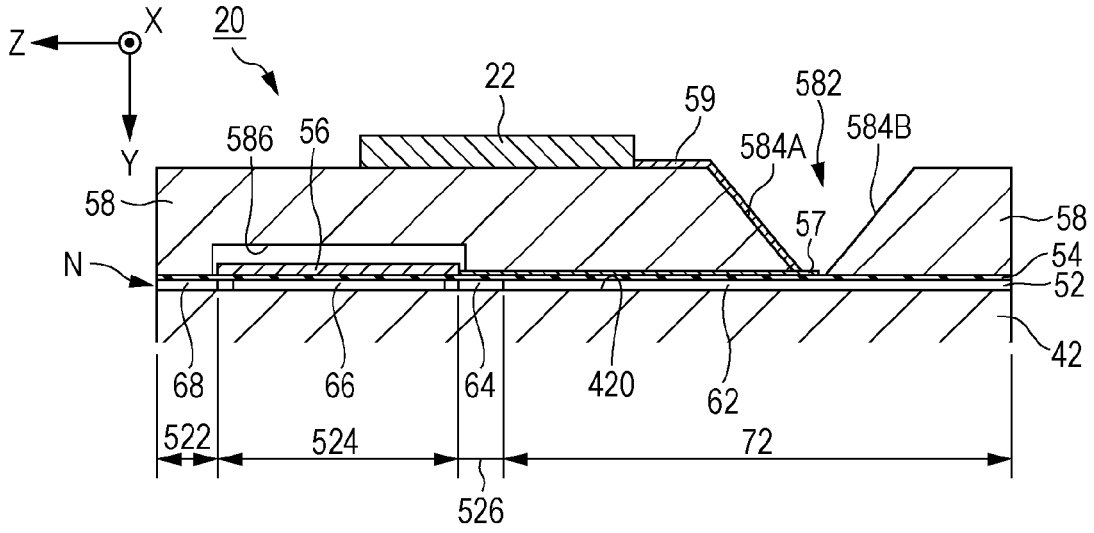
FIG. 4 is a cross-sectional view of the liquid ejecting head taken along line IV-IV in FIG. 2.

FIG. 3 illustrates plan views of the base substrate 42, the pressure chamber forming substrate 52, the diaphragm 54, and the protection plate 58, when viewed from the −Y direction. FIG. 4 is a cross-sectional view of the liquid ejecting head 20, taken along line IV-IV in FIG. 2. The base substrate 42 is a member having a plate shape extending in the X direction, as illustrated in FIG. 3. Any material or manufacturing method can be applied to the base substrate 42. A silicon (Si) single crystal substrate or a stainless steel substrate, for example, can be used as the base substrate 42. The base substrate 42 is a plate material functioning as a base for stacking members, such as the pressure chamber forming substrate 52, the diaphragm 54, and the protection plate 58. Furthermore, the base substrate 42 functions as a spacer for defining the Y-directional gap between the nozzle row GA and the nozzle row GB.

The pressure chamber forming substrate 52 is mounted on the mounting surface 420 of the base substrate 42, as illustrated in FIG. 4. The pressure chamber forming substrate 52 is fixed to the base substrate 42, using, for example, an adhesive. The pressure chamber forming substrate 52 is constituted of a base portion 71, a space forming portion 72, and side wall portions 73, as illustrated in FIG. 3. The base portion 71 is a portion on the Z-directional side (which is the ink ejecting side) of the pressure chamber forming substrate 52. In the base portion 71, ink flow paths (which are the nozzles N, first flow paths 522, opening portions 524, and second flow paths 526) corresponding to the respective nozzles N constituting the nozzle row GA are arranged, in the X direction, spaced apart from each other (generally, at equal intervals). The space forming portion 72 is located on the −Z-directional side (which is a side opposite to the ink ejection side) of the pressure chamber forming substrate 52. The space forming portion 72 is an opening portion of which three sides are surrounded by the base portion 71 and the side wall portions 73 on both sides of the pressure chamber forming substrate 52. The side wall portions 73 are portions on both sides of the space forming portion 72 and continuously extend from the base portion 71.

Each of the plurality ink flow paths formed in the base portion 71 is constituted of the nozzle N, the first flow path 522, the opening portion 524, and the second flow path 526, as illustrated in FIG. 3. The first flow path 522 linearly extends in the Z direction and allows the nozzle N to communicate with the opening portion 524. The opening portion 524 functions as a pressure chamber 66 for applying pressure to ink. The second flow path 526 linearly extends in the Z direction and allows the opening portion 524 to communicate with the space forming portion 72. The respective components (which are the nozzle N, the first flow path 522, the opening portion 524, and the second flow path 526) described above pass through the base portion 71 in the Y direction. Any material or manufacturing method can be applied to the pressure chamber forming substrate 52. A silicon single crystal substrate is selectively removed by, for example, semiconductor manufacturing technology, such as photolithography and etching, in such a manner that the pressure chamber forming substrate 52 is formed.

The silicon single crystal substrate (having a plate shape) fixed, using an adhesive, to the mounting surface 420 of the base substrate 42 or the surface of the diaphragm 54, which is the surface facing the base substrate 42, is subjected to, for example, anisotropic dry etching, in such a manner that the pressure chamber forming substrate 52 having a shape illustrated in FIG. 3 can be easily formed with high accuracy. In this case, the cross section of the nozzle N in the XY plane has a rectangular shape (generally, a square shape) and does not have a circular shape. However, according to the results of extensive studies by the inventor, it is possible to know that, even when the cross section of the nozzle N has a rectangular shape, adequate ink ejection properties can be ensured.

The respective components (which are the nozzle N, the first flow path 522, the opening portion 524, the second flow path 526, and the space forming portion 72) formed in the pressure chamber forming substrate 52 may not pass through the pressure chamber forming substrate 52 in the Y direction. Furthermore, the respective components described above may be formed by isotropic dry etching or isotropic wet etching. Alternatively, two silicon single crystal substrates may be bonded to form the pressure chamber forming substrate 52 and the components described above may be formed by performing isotropic dry etching or isotropic wet etching on the bonded surface of each silicon single crystal substrate. In this case, the cross section of the nozzle N can have a circular shape or a shape similar to a circular shape.

The diaphragm 54 is mounted on the surface of the pressure chamber forming substrate 52, which is the surface opposite to the surface facing the base substrate 42, as illustrated in FIG. 4. The diaphragm 54 is fixed, using, for example, an adhesive, to the pressure chamber forming substrate 52. The diaphragm 54 is a plate-shaped member capable of oscillating elastically. The diaphragm 54 has a configuration in which, for example, an elastic film formed of an elastic material, such as oxide silicon, and an insulation film formed of an insulating material, such as zirconium oxide, are stacked on each other. In the surface of the diaphragm 54, which is the surface opposite to the surface facing the pressure chamber forming substrate 52, a piezoelectric element 56 is disposed at the position corresponding to the plurality of opening portions 524 in the pressure chamber forming substrate 52, as illustrated in FIGS. 3 and 4. The piezoelectric element 56 is a laminated body in which a piezoelectric body is interposed between facing electrodes.

One electrode constituting the piezoelectric element 56 is, for example, a common electrode extending over the plurality of opening portions 524 and the other electrodes are a plurality of separate electrodes. The other electrode is separately formed for each opening portion 524. The piezoelectric body continuously extends over the plurality of opening portions 524. Furthermore, the piezoelectric body may be separately formed for each opening portion 524. The piezoelectric element 56 may be separately provided for each opening portion 524.

The space forming portion 72 interposed between the base substrate 42 and the diaphragm 54 functions as a liquid storage chamber (which is a reservoir) 62 which is a common liquid storage chamber of the plurality of nozzles N, as can be understood from FIGS. 3 and 4. The ink supplied from the ink cartridge 300 is stored in the liquid storage chamber 62. Both the diaphragm 54 and the piezoelectric element 56 are disposed on the opening portions 524 interposed between the base substrate 42 and the diaphragm 54, and thus the respective opening portions 524 function as the pressure chamber (which is a cavity) 66 for applying pressure to ink.

The respective second flow paths 526 (which are tubular spaces extending in the Z direction) interposed between the base substrate 42 and the diaphragm 54 allow the liquid storage chamber 62 to communicate with the pressure chambers 66. Thus, the second flow paths 526 function as the supply flow paths 64 through which the ink stored in the liquid storage chamber 62 is supplied to the respective pressure chambers 66. Accordingly, in the plurality of supply flow paths 64, the ink stored in the liquid storage chamber 62 is divided into plural streams, and then is supplied, in parallel, to the respective pressure chambers 66. As a result, the respective pressure chambers 66 are filled with ink. Furthermore, the respective first flow paths 522 (which are tubular spaces extending in the Z direction) interposed between the base substrate 42 and the diaphragm 54 function as communication flow paths 68 which allow the pressure chambers 66 to communicate with the nozzles N. As described above, the pressure chamber forming substrate 52 is a substrate in which the liquid storage chamber 62, the supply flow path 64, the pressure chamber 66, the communication flow path 68, and the nozzles N are formed. The ink flow path in the liquid ejecting head 20 is constituted of, in order, the liquid storage chamber 62, the supply flow path 64, the pressure chamber 66, the communication flow path 68, and the nozzle N, as can be understood from the above description.

A plurality of connection terminals 57 are formed on the surface of the diaphragm 54, which is the surface opposite to the surface facing the pressure chamber forming substrate 52, as illustrated in FIG. 4. The plurality of connection terminals 57 are electrically connected to both the common electrode and the separate electrodes of the piezoelectric element 56. The respective connection terminals 57 are arranged, in the X direction, spaced apart from each other (generally, at equal intervals). The respective connection terminals 57 are conductor patterns which linearly extend from the piezoelectric element 56 to the −Z-directional side.

The protection plate 58 is mounted on the surface of the diaphragm 54, which is the surface opposite to the surface facing the pressure chamber forming substrate 52, as illustrated in FIG. 4. The protection plate 58 is fixed, using, for example, an adhesive, to the surface of the diaphragm 54, in which the plurality of connection terminals 57 are formed. A concave portion 586 is formed in the surface of the protection plate 58, which is the surface facing the diaphragm 54. The piezoelectric element 56 is accommodated in the concave portion 586. The IC chip 22 having the driving circuit embedded therein is mounted on the surface of the protection plate 58, which is the surface opposite to the surface facing the diaphragm 54, as illustrated in FIGS. 3 and 4. Furthermore, an opening portion 582 which has a rectangular shape and has inclined surfaces 584A and 584B is formed on the −Z-directional side of the protection plate 58. In the surface of the protection plate 58, a plurality of signal wirings 59 extend from the IC chip 22 to the lower end portion of the inclined surface 584A, as illustrated in FIG. 4. Each signal wiring 59 is electrically connected to the connection terminal 57 corresponding to the signal wiring 59.

Accordingly, driving signals are supplied, through both the signal wiring 59 and the connection terminal 57, from the IC chip 22 (which is the driving circuit) to the respective electrodes of the piezoelectric element 56. The piezoelectric element 56 separately oscillates in accordance with the driving signals, for each area corresponding to the opening portion 524. Furthermore, the diaphragm 54 oscillates in accordance with the oscillation of the piezoelectric element 56, and thus the pressure (in other words, the volume of the pressure chamber 66) of the ink in the pressure chamber 66 varies. As a result, ink is ejected from the nozzles N, due to an increase in the pressure in the pressure chamber 66. As can be understood from the above description, the piezoelectric element 56 functions as a pressure generating element which causes the pressure in the pressure chamber 66 to vary, and in such a manner the ink in the pressure chamber 66 is ejected from the nozzles N. The diaphragm 54 is fixed, using, for example, an adhesive, to the protection plate 58, in which the diaphragm 54 is in close contact with the protection plate 58. Furthermore, the opening portion 582 of the protection plate 58 is sufficiently away from the piezoelectric element 56. Accordingly, only a part of the diaphragm 54, which is a portion corresponding to the concave portion 586 of the protection plate 58, oscillates in accordance with the driving signals.

According to Embodiment 1, ink is ejected in the Z direction along the pressure chamber forming substrate 52, as described above. Thus, the area of the liquid ejecting head 20, viewed from the ink ejection direction (which is the Z direction), can be reduced, compared to the configuration disclosed in JP-A-2013-154485, in which a pressure chamber forming substrate, a communication substrate, and a nozzle plate are disposed in a state where the posture thereof is perpendicular to the ink ejection direction. As a result, a plurality of nozzles N can be provided with high density and, further, it is easy to maintain a uniform gap between a liquid ejection surface and the printing medium 200, over the plurality of liquid ejecting heads 20.

According to Embodiment 1, since the pressure chamber 66, the communication flow path 68, and the nozzles N are formed in the same substrate (which is the pressure chamber forming substrate 52), the ink flow paths from the pressure chambers 66 to the nozzles N can be formed with high accuracy. Accordingly, it is possible to eliminate the possibility that an error may occur, in a flow path, at a bonded portion between the substrates and the extent of the error may vary due to temperature. As a result, it is possible to suppress the variation in ejection properties of ink ejected from the nozzles N. Furthermore, the pressure chamber 66, the communication flow path 68, and the nozzles N can be formed in the pressure chamber forming substrate 52, by a common process (for example, anisotropic dry etching). As a result, it is possible to simplify the manufacturing process of the liquid ejecting head 20.

According to Embodiment 1, it is not necessary to provide a nozzle plate. When the nozzle plate is provided, the nozzle plate is fixed in a close-contact state. Thus, in the surfaces (which are the Z-directional lateral surfaces of the base substrate 42, the pressure chamber forming substrate 52, the diaphragm 54, and the protection plate 58) to which the nozzle plate is fixed, it is necessary to sufficiently reduce a difference in level. In other words, manufacturing or assembling the liquid ejecting head 20 requires high accuracy. In contrast, according to this embodiment, since it is not necessary to provide a nozzle plate, the number of parts is reduced. Thus, the configuration of the liquid ejecting head 20 can be simplified. Furthermore, it is not necessary to flatten the surfaces to which a nozzle plate is bonded. As a result, it is possible to reduce the accuracy necessary for manufacturing or assembling of the liquid ejecting head 20.

Therefore, according to Embodiment 1, the area of the liquid ejecting head 20, viewed from the ink ejection direction, can be reduced and the variation in ejection properties can be suppressed with a simple configuration. Furthermore, according to Embodiment 1, the liquid storage chamber 62 and the supply flow path 64 are also formed in the pressure chamber forming substrate 52. As a result, the configuration of the liquid ejecting head 20 can be simplified, compared to the configuration in which the liquid storage chamber 62 and the supply flow path 64 are formed in a substrate separate from the pressure chamber forming substrate 52.

Embodiment 2

Next, Embodiment 2 will be described. In the following descriptions of Embodiments 2 to 4, the same reference numerals and letters are given to components of which the configurations are the same as those in Embodiment 1. Furthermore, the descriptions thereof will not be repeated.

Figure 5:
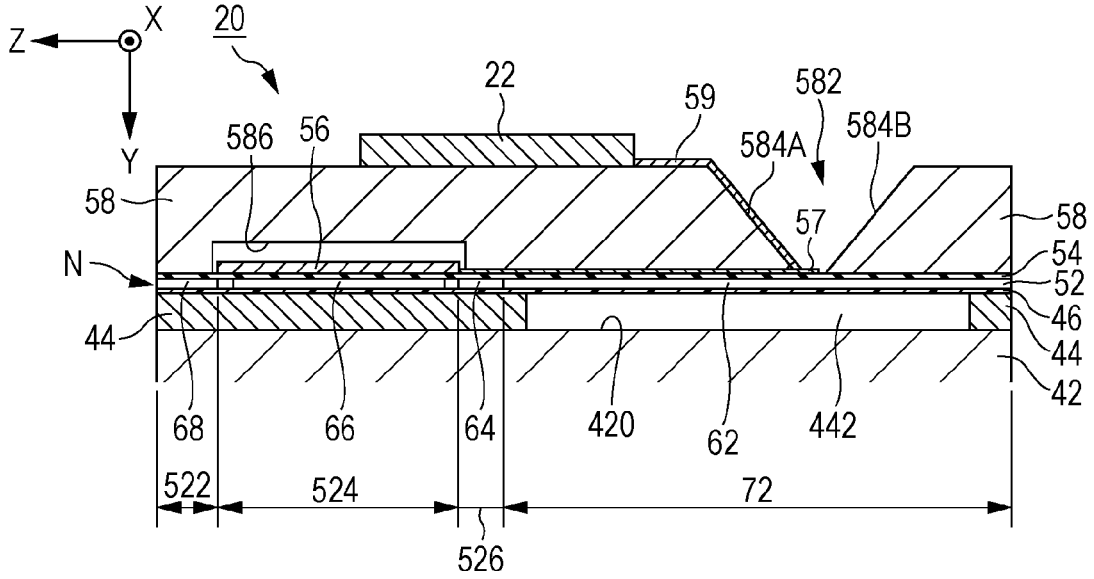
FIG. 5 is a cross-sectional view of a liquid ejecting head according to Embodiment 2.
Figure 6:
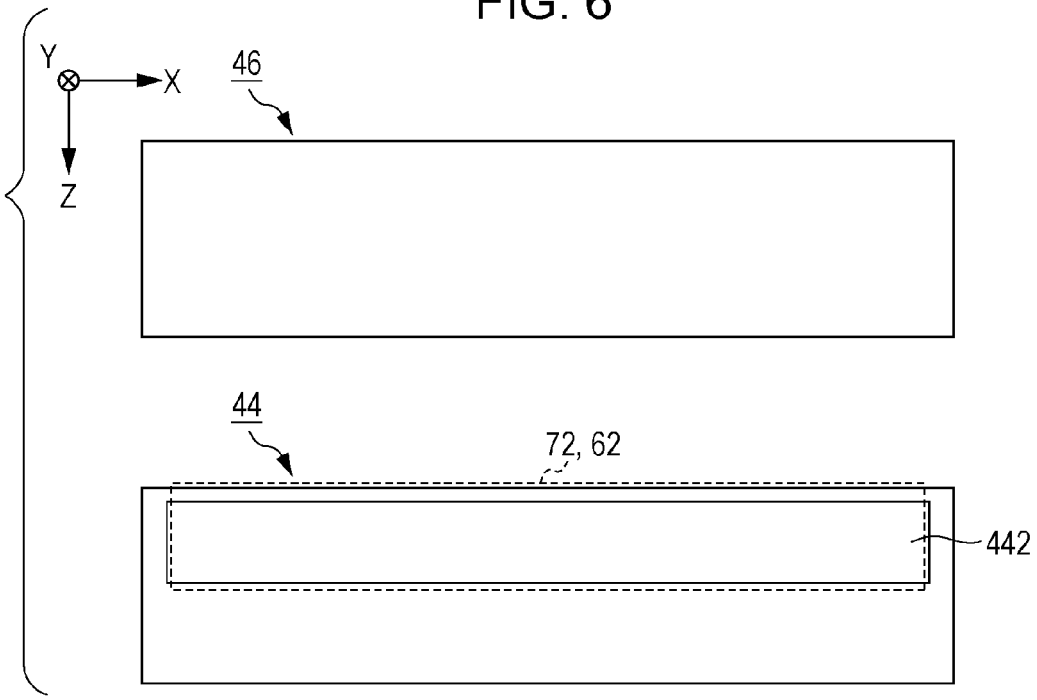
FIG. 6 illustrates plan views of a compliance plate and a compliance sheet.

FIG. 5 is a cross-sectional view of the liquid ejecting head 20 according to Embodiment 2. FIG. 5 corresponds to FIG. 4 which is referred to in Embodiment 1. FIG. 6 illustrates plan views of a compliance plate 44 and a compliance sheet 46. As can be understood from FIGS. 5 and 6, the configuration of the liquid ejecting head 20 according to Embodiment 2 and the configuration of the liquid ejecting head 20 described in Embodiment 1 have a difference in that both the compliance plate 44 and the compliance sheet 46 are further provided in the liquid ejecting head 20 of Embodiment 2.

The compliance plate 44 is provided on the mounting surface 420 of the base substrate 42, as illustrated in FIG. 5. The compliance plate 44 is fixed, using, for example, an adhesive, to the base substrate 42. The compliance plate 44 has a rectangular shape extending in the X direction, as illustrated in FIG. 6. In the −Z-directional side of the compliance plate 44, an opening portion 442 is provided in a state where the opening portion 442 passes through, in the Y direction, the compliance plate 44. The size or the position of the opening portion 442 substantially corresponds to the space forming portion 72 (which is the liquid storage chamber 62) of the pressure chamber forming substrate 52. Any material can be used as the compliance plate 44. For example, a metallic material, such as stainless steel, can be used as a material of the compliance plate 44.

The compliance sheet 46 is provided over the surface of the compliance plate 44, which is the surface opposite to the surface facing the base substrate 42, as illustrated in FIGS. 5 and 6. The compliance sheet 46 is a sheet having flexibility and is constituted of, for example, synthetic resin or a metallic material. The compliance sheet 46 is fixed, in a close-contact manner, to the compliance plate 44, using, for example, an adhesive, except for a part of the compliance sheet 46, which is the portion corresponding to the opening portion 442 of the compliance plate 44. Accordingly, when a pressure is applied to the compliance sheet 46, only a part of the compliance sheet 46, which is the portion corresponding to the opening portion 442, is bent.

The pressure chamber forming substrate 52 is fixed, using, for example, an adhesive, to the surface of the compliance sheet 46, which is the surface opposite to the surface facing the base substrate 42, as illustrated in FIG. 5. As described in Embodiment 1, the pressure chamber forming substrate 52 is the substrate in which the liquid storage chamber 62, the supply flow path 64, the pressure chamber 66, the communication flow path 68, and the nozzles N are formed. Accordingly, the ink flow path from the liquid storage chamber 62 to the nozzle N has the same configuration as that in Embodiment 1. In the liquid storage chamber 62, a wall surface on the base substrate 42 side is constituted of the compliance sheet 46 having flexibility, as illustrated in FIG. 5. Most of a part of the compliance sheet 46, which is the portion constituting the wall surface of the liquid storage chamber 62, faces the opening portion 442 and is not fixed to the compliance plate 44. Accordingly, pressure change in the liquid storage chamber 62 can be absorbed by the compliance sheet 46.

In the case of Embodiment 2 described above, similarly to Embodiment 1, the area of the liquid ejecting head 20, viewed from the ink ejection direction (which is the Z direction), can be reduced and the variation in ejection properties can be suppressed with a simple configuration. Furthermore, according to Embodiment 2, the wall surface of the liquid storage chamber 62 is constituted of the compliance sheet 46 which has flexibility and is provided on the surface of the pressure chamber forming substrate 52, which is the surface facing the base substrate 42. Accordingly, pressure change in the liquid storage chamber 62 can be absorbed by the compliance sheet 46. Furthermore, it is possible to more stably supply, to the pressure chamber 66, the ink stored in the liquid storage chamber 62, compared to the configuration in which the compliance sheet 46 is not provided. As a result, it is possible to further suppress the variation in ejection properties.

Embodiment 3

Figure 7:
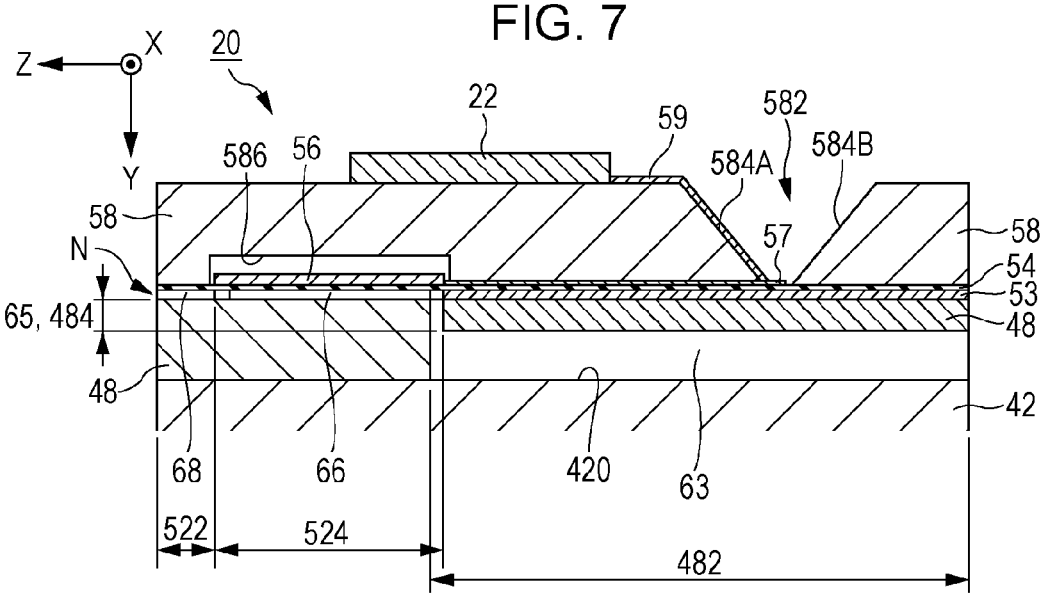
FIG. 7 is a cross-sectional view of a liquid ejecting head according to Embodiment 3.
Figure 8:
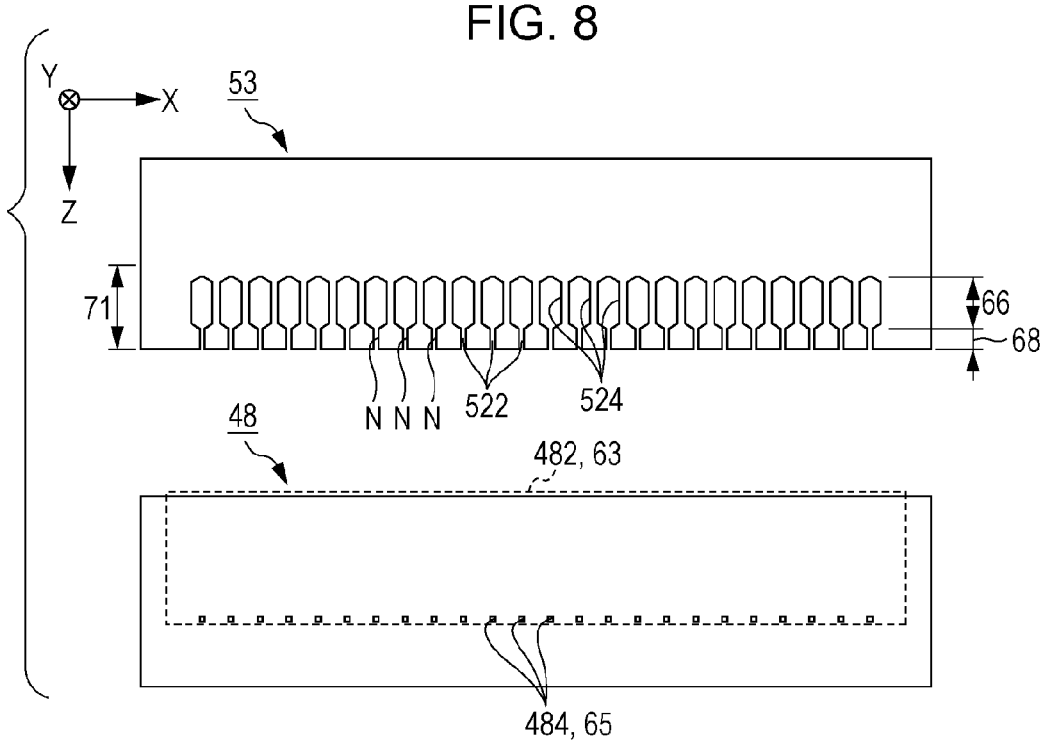
FIG. 8 illustrates plan views of a communication plate and a pressure chamber forming substrate.

FIG. 7 is a cross-sectional view of the liquid ejecting head 20 according to Embodiment 3. FIG. 8 illustrates plan views of a communication plate 48 and a pressure chamber forming substrate 53, seen from the −Y direction. Upon comparison with the liquid ejecting head 20 described in Embodiment 1, the communication plate 48 is further provided in the liquid ejecting head 20 of Embodiment 3, as can be understood from FIGS. 7 and 8. The liquid ejecting head 20 of Embodiment 3 and the liquid ejecting head 20 of Embodiment 1 have a difference in that both a liquid storage chamber 63 (which is a space forming portion 482) and a supply flow path 65 (which is a through-hole 484) are formed not in a pressure chamber forming substrate 53 but in the communication plate 48.

The communication plate 48 is provided on the mounting surface 420 of the base substrate 42, as illustrated in FIG. 7. The communication plate 48 is fixed, using, for example, an adhesive, to the base substrate 42. The communication plate 48 has a rectangular shape extending in the X direction, as illustrated in FIG. 8. The space forming portion (which is a concave portion) 482 functioning as the liquid storage chamber 63 is formed on the −Z-directional side of the surface of the communication plate 48, which is the surface facing the base substrate 42. Furthermore, in the communication plate 48 (specifically, in the Z-directional end portion of the space forming portion 482), a plurality of through-holes 484 which pass through the communication plate 48 in the Y direction are arranged, in the X direction, spaced apart from each other (generally, at equal intervals), as illustrated in FIG. 8.

The pressure chamber forming substrate 53 is fixed, using, for example, an adhesive, to the surface of the communication plate 48, which is the surface opposite to the surface facing the base substrate 42, as illustrated in FIG. 7. In the base portion 71 on the Z-directional side of the pressure chamber forming substrate 53, parts (which are the nozzles N, the first flow paths 522, and the opening portions 524) of the ink flow paths corresponding to the respective nozzles N constituting the nozzle row GA are arranged, in the X direction, spaced apart from each other (generally, at equal intervals), as illustrated in FIG. 8.

The space forming portion 482 interposed between the base substrate 42 and the communication plate 48 functions as the liquid storage chamber 63 which is a common liquid storage chamber of the plurality of nozzles N, as can be understood from FIGS. 7 and 8. Each through-hole 484 allows the liquid storage chamber 63 to communicate with the pressure chamber 66. The through-hole 484 functions as the supply flow path 65 through which the ink stored in the liquid storage chamber 63 is supplied to the pressure chamber 66. The configuration of the ink flow path from the pressure chamber 66 to the nozzle N is the same as that of Embodiment 1. As can be understood from FIGS. 3 and 8, the pressure chamber forming substrate 52 of Embodiment 1 is the substrate in which the liquid storage chamber 62, the supply flow path 64, the pressure chamber 66, the communication flow path 68, and the nozzles N are formed and the pressure chamber forming substrate 53 of Embodiment 3 is the substrate in which the pressure chamber 66, the communication flow path 68, and the nozzles N are formed. In Embodiment 3, the liquid storage chamber 63 (which is the space forming portion 482) and the supply flow path 65 (which is the through-hole 484) are formed not in the pressure chamber forming substrate 53 but in the communication plate 48.

In the liquid ejecting head 20 of Embodiment 3, the space forming portion 482 of the communication plate 48 functions as the liquid storage chamber 63, as described above. Accordingly, upon comparison with the case of Embodiment 1 or Embodiment 2, the liquid storage chamber 63 having adequate capacity can be obtained regardless of the thickness of the pressure chamber forming substrate 53. When, for example, the capacity of the liquid storage chamber 63 is small, the flow-path resistance increases. Thus, when the piezoelectric element 56 is driven at a high frequency, there is a possibility that inadequate ink supply may occur. However, according to this embodiment, it is possible to eliminate inadequate ink supply at the time of high-frequency driving of the piezoelectric element 56. As a result, high-speed printing can be performed.

As described above, the liquid ejecting head 20 of Embodiment 3 includes the communication plate 48 which is disposed on the surface of the pressure chamber forming substrate 53, which is the surface facing the base substrate 42, and forms the liquid storage chamber 63 in which ink to be supplied to the pressure chamber 66 is stored. Even in this embodiment, similarly to Embodiment 1, the area of the liquid ejecting head 20, viewed from the ink ejection direction (which is the Z direction), can be reduced and the variation in ejection properties can be suppressed with a simple configuration. Furthermore, according to Embodiment 3, the liquid storage chamber 63 is formed in the communication plate 48 which is a substrate separate from the pressure chamber forming substrate 53. Thus, the liquid storage chamber 63 having adequate capacity can be obtained regardless of the thickness of the pressure chamber forming substrate 53 (for example, even when the thickness of the pressure chamber forming substrate 53 is thin). Accordingly, it is possible to eliminate inadequate ink supply at the time of high-frequency driving of the piezoelectric element 56. As a result, high-speed printing can be performed.

Embodiment 4

Figure 9:
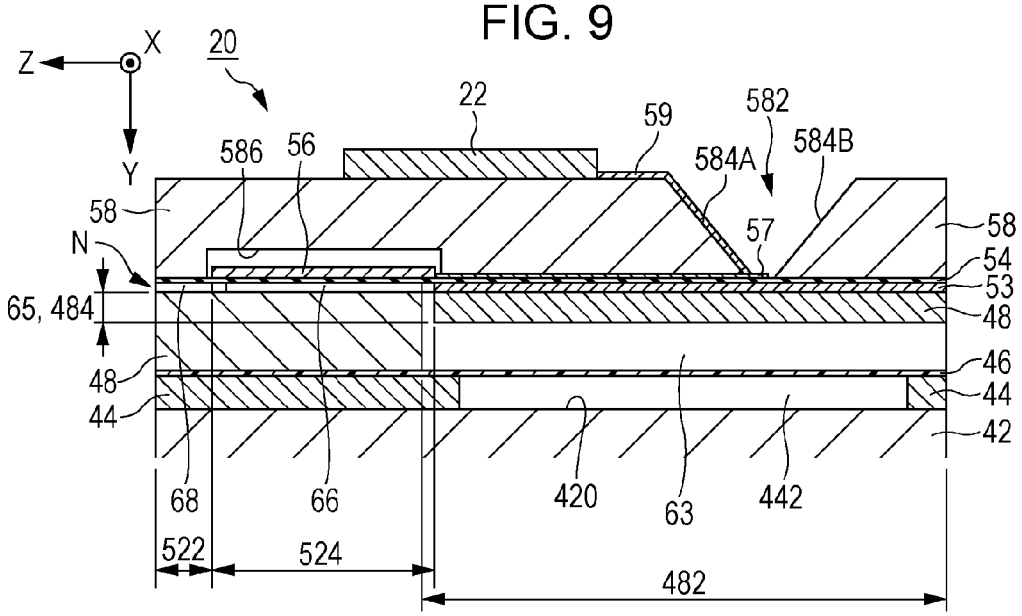
FIG. 9 is a cross-sectional view of a liquid ejecting head according to Embodiment 4.

FIG. 9 is a cross-sectional view of the liquid ejecting head 20 according to Embodiment 4. The liquid ejecting head 20 of Embodiment 4 has a configuration in which the configurations of Embodiments 2 and 3 are used in combination, as can be understood from FIG. 9. The configuration of the liquid ejecting head 20 of Embodiment 4 and the configuration of the liquid ejecting head 20 described in Embodiment 1 has a difference in that the liquid ejecting head 20 of Embodiment 4 includes the compliance plate 44 and the compliance sheet 46 which are described in Embodiment 2 and the communication plate 48 and the pressure chamber forming substrate 53 which are described in Embodiment 3.

The compliance plate 44, the compliance sheet 46, the communication plate 48, and the pressure chamber forming substrate 53, in addition to the diaphragm 54 and the protection plate 58, are stacked on the base substrate 42, as illustrated in FIG. 9. The compliance plate 44 and the compliance sheet 46 are similar to those described in Embodiment 2 and the configurations thereof are as illustrated in FIG. 6, except that the Z-directional width of the opening portion 442 of the compliance plate 44 is slightly greater than that of Embodiment 2. The size or the position of the opening portion 442 substantially corresponds to the space forming portion 482 (which is the liquid storage chamber 63) of the communication plate 48. Furthermore, the communication plate 48 and the pressure chamber forming substrate 53 are similar to those described in Embodiment 3 and the configurations thereof are as illustrated in FIG. 8.

Even in the case of Embodiment 4, similarly to Embodiment 1, the area of the liquid ejecting head 20, viewed from the ink ejecting direction (which is the Z direction), can be reduced and the variation in ejection properties can be suppressed with a simple configuration. Furthermore, according to Embodiment 4, the wall surface of the liquid storage chamber 63 is constituted by the compliance sheet 46 which has flexibility and is disposed on the surface of the communication plate 48, which is the surface facing the base substrate 42. In addition, most of a part of the compliance sheet 46, which is the portion constituting the wall surface of the liquid storage chamber 63, faces the opening portion 442 and is not fixed to the compliance plate 44. Accordingly, a pressure change in the liquid storage chamber 63 can be absorbed by the compliance sheet 46. Furthermore, according to Embodiment 4, since the liquid storage chamber 63 is formed in the communication plate 48 which is a substrate separate from the pressure chamber forming substrate 53, the liquid storage chamber 63 having adequate capacity can be obtained regardless of the thickness of the pressure chamber forming substrate 53. Accordingly, it is possible to eliminate inadequate ink supply at the time of high-frequency driving of the piezoelectric element 56. As a result, high-speed printing can be performed.

MODIFICATION EXAMPLES

The embodiments described above can be modified in various ways. Examples of the specific aspects of modification are described below. Two aspects or more selected from the examples described below can be appropriately combined as long as they do not contradict each other.

(1) In the embodiments described above, the nozzle row GA is formed in one mounting surface 420 of the base substrate 42 and the nozzle row GB is formed in the other mounting surface 420. However, the components in either one of the mounting surfaces 420 may be removed. In other words, a nozzle row can be formed in only one mounting surface 420 of the base substrate 42. However, when nozzle rows are formed in both mounting surfaces 420 of the base substrate 42, a plurality of nozzles N can be provided with high density. The number of nozzles N is not limited to the plural number and may be one or more. When the number of nozzles N is one, the number of communication flow paths 68, the pressure chambers 66, the supply flow paths 64, the supply flow paths 65, or the like is one.

Figure 10:
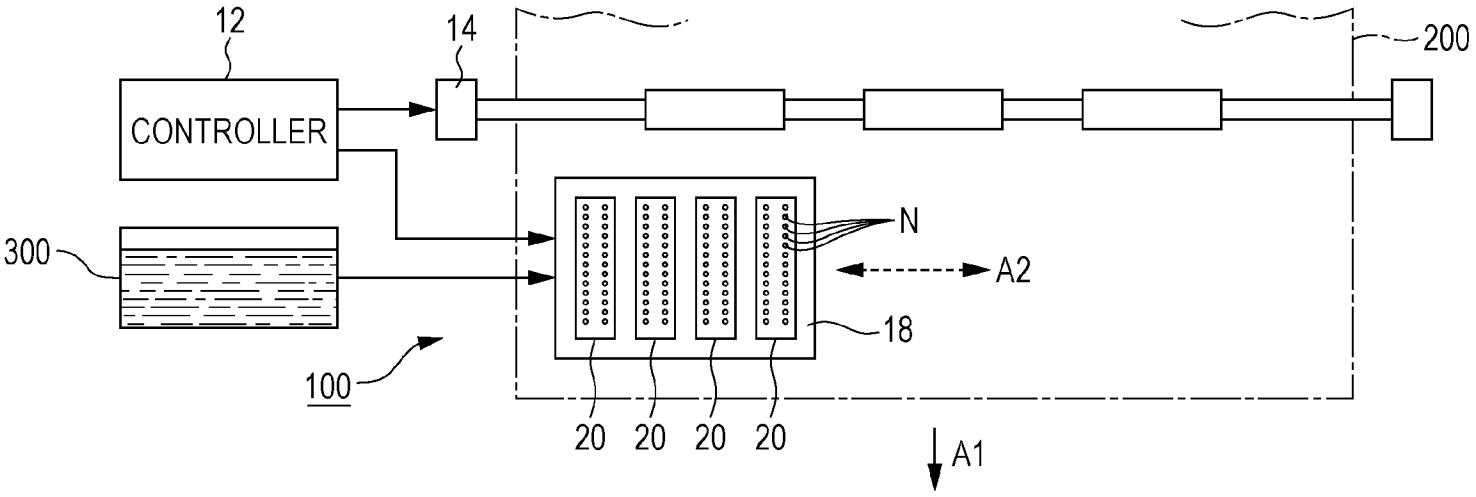
FIG. 10 is a partial configuration view of a printing apparatus according to a modification example.

(2) The head module 16 (which is a line head) in which a plurality of liquid ejecting heads 20 are arranged in the direction A2 perpendicular to the transporting direction A1 of the printing medium 200 is exemplified in the embodiments described above. However, the invention can be applied to a serial head. For example, a head module 18 illustrated in FIG. 10 is a serial head in which a plurality of liquid ejecting heads 20 according to the embodiments described above are mounted on a carriage. The head module 18 reciprocates in the direction A2 and ejects ink through the respective nozzles N, while the printing medium 200 is transported (in the direction A1).

(3) In the embodiments described above, the IC chip 22 may not be provided on the protection plate 58. A driving circuit for generating driving signals may be provided in the controller 12 and the driving signals from the driving circuit may be supplied to the connection terminal 57 through a flexible wiring substrate. In this case, it is not necessary to form the signal wiring 59 on the surface of the protection plate 58. Furthermore, the IC chip 22 may be provided on the flexible wiring substrate, in a Chip-On-Film (COF) manner. When a case in which a driving circuit is provided in the controller 12 and a case in which the IC chip 22 is provided on a flexible wiring substrate are compared to each other, the latter can achieve the condition that the driving circuit is located closer to the liquid ejecting head 20. Accordingly, it is possible to obtain an effect, such as improved noise-resistance properties and a reduction in distortion of driving-signal wave form. Furthermore, in the case where the driving circuit is provided in the controller 12 or the case where the IC chip 22 is provided on a flexible wiring substrate, the driving signals from the driving circuit may be supplied not to the connection terminal 57 formed on the surface of the diaphragm 54 but to the signal wiring 59 formed on the surface of the protection plate 58. In this case, the driving signals are supplied to the piezoelectric element 56, through both the signal wiring 59 and the connection terminal 57. The diaphragm 54 having the connection terminal 57 formed therein faces the pressure chamber forming substrate 53 and constitutes the wall surface of the ink flow path. Accordingly, in a case where the driving signals are supplied to the connection terminal 57, when a wiring substrate is pressed to the connection terminal 57, at the time of connecting the flexible wiring substrate and the connection terminal 57, there is a possibility that distortion may occur in the ink flow path, due to a pressing force. In contrast, when the driving signals are supplied to the signal wiring 59, a flexible wiring substrate is connected to the signal wiring 59 on the protection plate 58. Thus, even when the flexible wiring substrate is pressed to the signal wiring 59, at the time of connecting the flexible wiring substrate and the signal wiring 59, distortion does not occur in the ink flow path.

(4) In Embodiment 2 or Embodiment 4, the compliance sheet 46 may be disposed in only the portion corresponding to the liquid storage chamber 62 or 63.

(5) A component (which is a pressure generating element) for changing the pressure in the pressure chamber 66 is not limited to the piezoelectric element 56. For example, an oscillating body, such as an electrostatic actuator, can be used as a pressure generating element. Furthermore, a pressure generating element is not limited to a component which applies mechanical oscillation to the pressure chamber 66. For example, a heater element (which is a heater) which generates, in a heating manner, air bubbles in the pressure chamber 66, in such a manner that the pressure in the pressure chamber 66 changes, can be used as a pressure generating element. Any element can be used as a pressure generating element, as long as it changes the pressure in the pressure chamber 66. The pressure changing method (for example, a piezoelectric method or a thermal method) or the specific configuration of a pressure generating element is not limited.

(6) The liquid ejecting apparatus of the invention can also be applied to an apparatus, such as a facsimile machine and a copying machine, other than a printer. In addition, a use of the liquid ejecting apparatus according to the invention is not limited to printing. For example, a liquid ejecting apparatus for ejecting a solution of coloring material can be used as a manufacturing apparatus for forming a color filter for a liquid crystal display. Furthermore, a liquid ejecting apparatus for ejecting a solution of conductive material can be used as a manufacturing apparatus for forming wiring or an electrode of a wiring substrate.

What is claimed is:

1. A liquid ejecting head comprising:

a base substrate;

a diaphragm upon which a pressure generating element is disposed;

a pressure chamber forming substrate for forming a pressure chamber which is filled with liquid, wherein the pressure chamber forming substrate is a single substrate element;

a communication plate which is disposed on one surface of the pressure chamber forming substrate and forms a liquid storage chamber in which liquid to be supplied to the pressure chamber is stored;

a nozzle through which the liquid is ejected in a direction intersecting with a thickness direction of the pressure chamber forming substrate; and a communication flow path which allows the pressure chamber to communicate with the nozzle, wherein the nozzle and the communication flow path are formed in the pressure chamber forming substrate, wherein the liquid storage chamber is formed by the base substrate and the communication plate, wherein the communication plate forms a supply flow path through which the liquid stored in the liquid storage chamber is supplied to the pressure chamber, wherein the pressure chamber forming substrate is interposed between the communication plate and the diaphragm, wherein the pressure chamber corresponds to an opening portion which penetrates the pressure chamber forming substrate.

2. The liquid ejecting head according to claim 1, further comprising:

a compliance sheet having flexibility which is disposed on a surface of the communication plate, which is the surface opposite to a surface facing the pressure chamber forming substrate, and constitutes a wall surface of the liquid storage chamber.

3. A liquid ejecting apparatus comprising:

the liquid ejecting head according to claim 1.

4. A liquid ejecting apparatus comprising:

the liquid ejecting head according to claim 2.

* * * * *